United States Patent [19]

Kilpatrick et al.

[11] 3,986,256

[45] Oct. 19, 1976

[54] ADAPTER FOR POSITIONING MULTI-CONDUCTOR CABLE AND ELECTRICAL CONNECTOR

[75] Inventors: Jerry Blanton Kilpatrick, Greensboro; John James Tucci, Winston-Salem, both of N.C.

[73] Assignee: AMP Incorporated, Harrisburg, Pa.

[22] Filed: Nov. 17, 1975

[21] Appl. No.: 632,754

[52] U.S. Cl. ..... 29/628; 29/203 H; 29/203 MW; 29/203 P

[51] Int. Cl.[2] ..... H01R 43/00

[58] Field of Search ..... 29/628, 203 D, 203 H, 29/203 HC, 203 HM, 203 P, 203 MN, 630 R, 630 A, 33 M, 206 R, 206 D

[56] References Cited

UNITED STATES PATENTS

| | | | |
|---|---|---|---|
| 3,571,890 | 3/1971 | Brehm | 29/203 HT |
| 3,628,202 | 12/1971 | Brown | 29/278 X |
| 3,758,935 | 9/1973 | Long et al. | 29/203 HT |
| 3,766,622 | 10/1973 | Brehm | 29/203 MW |
| 3,838,491 | 10/1974 | Mayberry et al. | 29/203 H |

*Primary Examiner*—C.W. Lanham
*Assistant Examiner*—James R. Duzan
*Attorney, Agent, or Firm*—Robert W. Pitts; F. W. Raring; Jay L. Seitchik

[57] ABSTRACT

A wire positioning adapter for dressing wires from a multi-conductor cable to transverse terminal locations is disclosed. The adapter is used with a standard semi-automatic insertion apparatus which simultaneously attaches a pair of conductors to oppositely facing terminals. The adapter moves along a linear path with respect to the connector. Wires are laced across a wire positioning surface between the cable end and the terminals. The wires are allowed to longitudinally slip across this surface during movement of the adapter.

19 Claims, 12 Drawing Figures

Fig 1
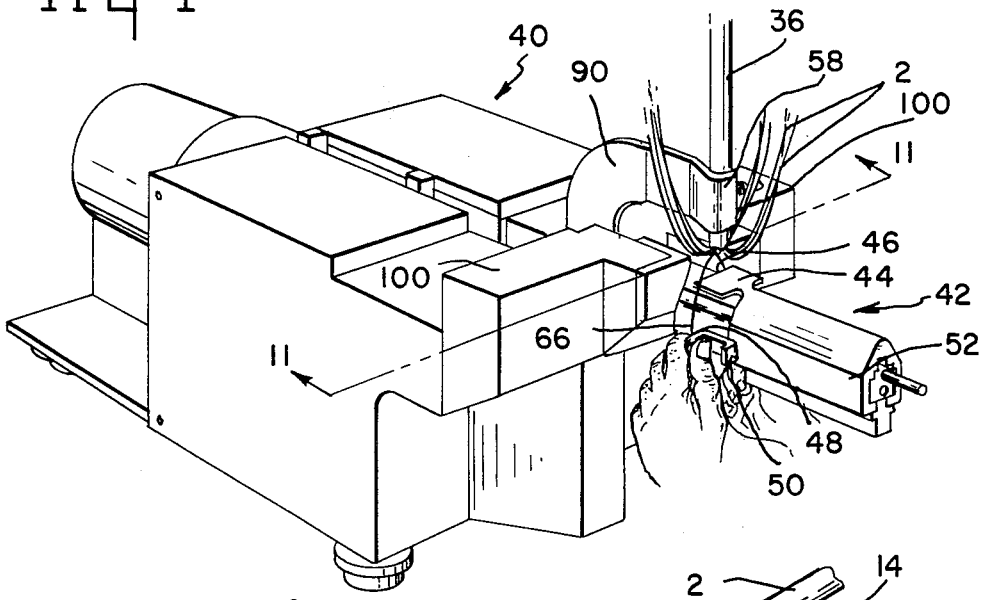
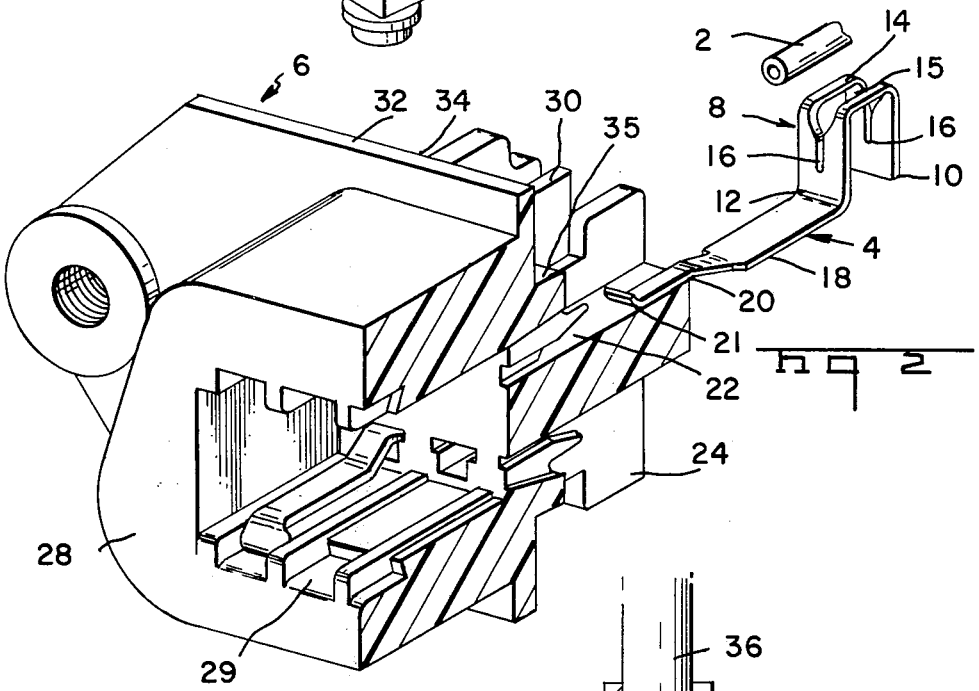
Fig 2
Fig 3
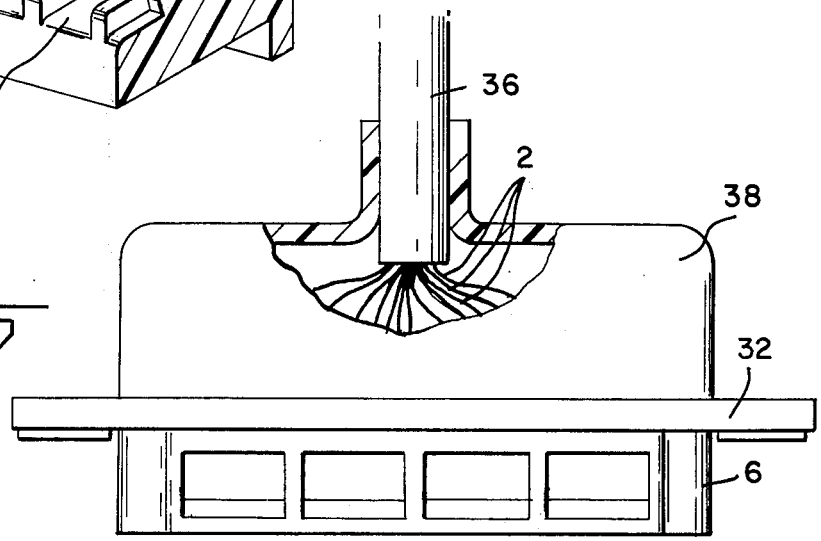

ADAPTER FOR POSITIONING MULTI-CONDUCTOR CABLE AND ELECTRICAL CONNECTOR

BACKGROUND OF THE INVENTION

1. Field of Invention

This invention relates to a semi-automatic machine for inserting the wires in a multi-conductor cable into wire receiving portions of terminals located in two parallel rows in a multi-contact electrical connector. This invention can be used with a standard semi-automatic insertion apparatus to attach wires to connectors having wire-receiving terminals which capture a wire upon movement on the wire laterally of its axis into the wire receiving portions. The adapter which is the subject of this invention is used to dress or position the wires and the cable.

2. Description of the Prior Art

A semi-automatic insertion apparatus is disclosed and claimed in U.S. Pat. No. 3,766,622. Such a standard semi-automatic apparatus can be used with a connector such as that shown in U.S. Pat. No. 3,760,335 or the connector shown in U.S. Pat. No. 3,867,005. Each of these connectors have terminals with laterally facing wire receiving portions. Wires are attached to these terminals by moving the wire laterally of its axis and into the wire receiving portions.

The semi-automatic insertion apparatus shown in U.S. Pat. No. 3,766,622 has a movable carriage for positioning the connector and the cable. The carriage moves parallel to the terminal rows in the connector. Each terminal therefore moves through an insertion station. Insertion punches move into this insertion station along a path transverse to the direction in which the carriage moves. The cable is fixed to the carriage and extends parallel to the terminal rows.

BRIEF SUMMARY OF THE INVENTION

This invention relates to a wire dressing or wire positioning adapter for use with a standard semi-automatic insertion apparatus such as that discussed above. When using a standard insertion apparatus, the wires in a multi-conductor cable are attached to terminals in the connector so that the cable ultimately extends parallel to the terminal rows. In some situations, that orientation of the cable relative to the conductor can be cumbersome. Often, it is desirable to have the cable ultimately extend perpendicular to the terminal rows. That cable connector configuration would have a cable located intermediate the ends of the terminal rows. Individual wires would then extend from the multi-conductor cable, in a symmetrical fashion, to terminals on both sides of the cable. Such a configuration offers space saving advantages where numerous side by side connectors are densely packed in multiple layers. A telephone PBX installation is one such example.

This invention provides an apparatus and a method for easily fabricating such a cable connector configuration. The cable is clamped intermediate the terminal row ends and extends perpendicular to the rows. A wire positioning surface moves along a linear path between the clamp and the connector to present wires at the insertion station. This wire positioning surface is movable with respect to the carriage supporting the connector and with respect to the connector. Each wire is raised over the wire positioning surface and during movement of the adapter the wire is free to longitudinally slip across this surface. This adapter is intended for use where wires must be dressed from the clamp to terminals on the far end of the connector.

An adapter consistent with the above description is intended to accomplish the following objects. This invention must provide a simple method of attaching the wires in an outwardly extending multi-conductor cable to terminals on both sides of the cable. The adapter must be a relatively simple device which can be used with a standard semi-automatic wire insertion apparatus. Consistent with the last mentioned object the adapter needs to be easily removable. While this invention would provide the basis for an automatic apparatus, one object of the invention is to provide a hand operated adapter such as disclosed and claimed at this application. Therefore, one of the objects of this invention is to provide an adapter with which an operator can hold the wires in his hands and simultaneously actuate the adapter with his hands. Another object of this invention is to provide an adapter which does not interfere with conventional dressing and positioning of certain wires in the cable.

These and other objects of the invention are achieved in connection with an invention which is embodied in the disclosed configuration.

BRIEF SUMMARY OF THE DRAWINGS

FIG. 1 shows an adapter mounted on a standard semi-automatic insertion apparatus and illustrates the hand operation of the adapter and the insertion apparatus.

FIG. 2 shows one multi-contact electrical connector which can be used with this device.

FIG. 3 shows a multi-conductor cable attached to the connector shown in FIG. 2 and extending perpendicular to the terminal rows.

Figure 4:
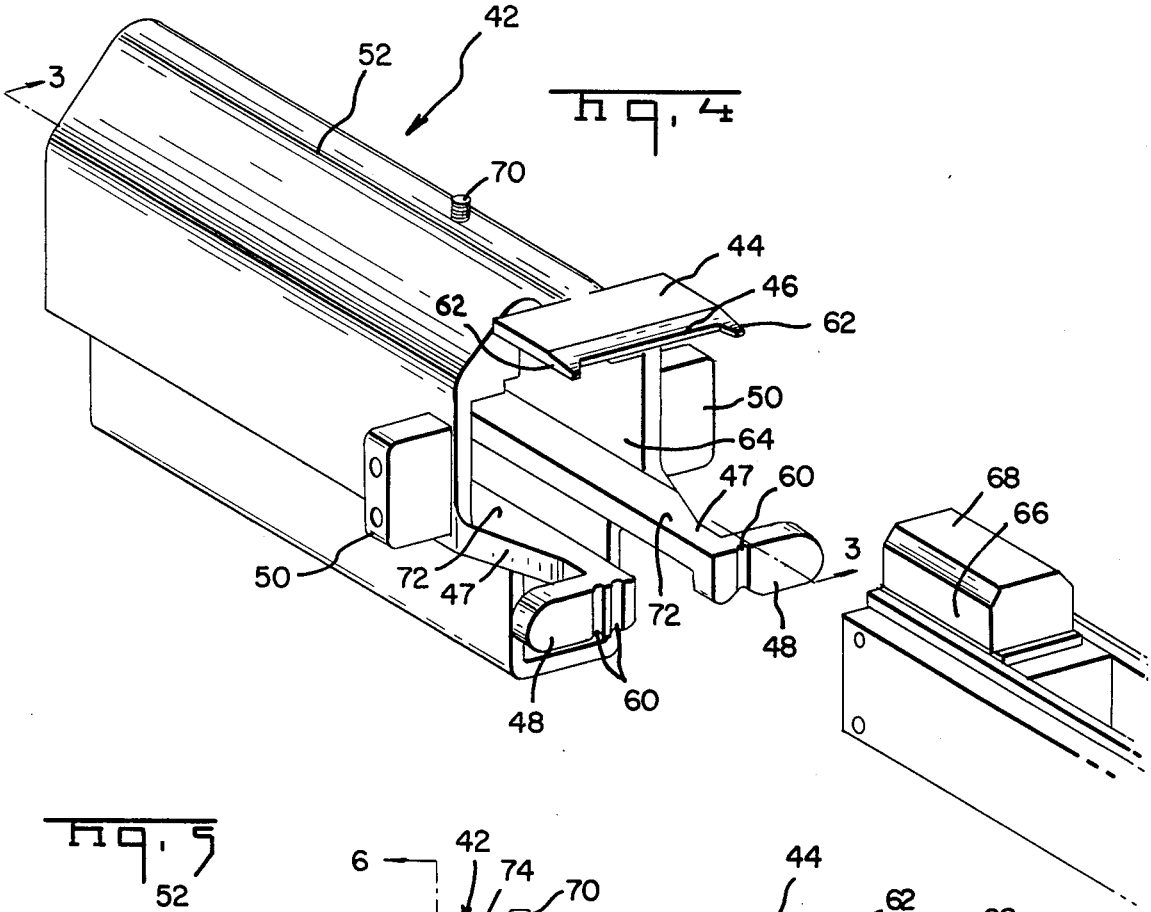
FIG. 4 shows the adapter and illustrates the manner in which the adapter is mounted on the standard insertion apparatus.

The herein disclosed embodiment of the invention is intended to insert an insulated wire 2 into the terminal receiving portion 8 of each one of a plurality of electrical terminals 4 contained in an electrical connector 6. Connectors and terminals as disclosed in FIG. 2 are fully described in U.S. Pat. No. 3,760,335, however, some structural features of the connector and the terminal must be described here for an understanding of the present invention. The wire receiving portion 8 of each terminal is generally U-shaped having spaced apart parallel plate-like sections 10, 12 which are connected by a bight section 14. A slot extends through the bight at 15 and into the plate-like sections at 16 so that when the wire is forced downwardly and to the slot, the edges of the slot will penetrate the insulation of the wire and establish electrical contact with the conducting core thereof.

The terminal 4 further comprises a flat shank 18 extending from plate section 12 and an offset contact portion 20 which has a laterally extending ear 21 on its end. A plurality of cavities 22 extend through the connector housing from the rearward side 24 thereof and open into a trough 26 in the forward or mating side 28 of the housing. These cavities and recesses 29 on the sides of the trough 26 are contoured to receive the terminals 4. The connectors shown are adapted to be mated with a complementary connector as disclosed in U.S. Pat. No. 3,760,335. Barriers 30 are provided on the connector housing adjacent to the rearward face 24 between adjacent cavities 22. It should also be noted that a flange 32 extends outwardly from the housing between the rearward and mating faces and a rearwardly facing surface 34 and ledge 35 are defined by the rearwardly facing side of this flange.

FIG. 3 shows a cable connector configuration in which the cable is located intermediate the ends of the connector. One row of terminals and their respective outwardly facing wire receiving portions is shown with wires attached. Another row of terminals is located parallel to the rows shown and along the back of this connector. A plurality of wires form multi-conductor cable 36. These wires extend outwardly in both directions and are attached to terminals 4 as shown. Cable 36 extends perpendicular to each row of terminals and is located intermediate their ends. The conventional manner of attaching a multi-conductor cable to a connector of this type is to have the cable extend parallel to each terminal row. In the conventional arrangement, wires connected to terminals adjacent the cable would be shorter than wires extending to the far end of the connector. With cable 36 located at the center of each row the wires at each end are approximately the same length. It should be apparent that the configuration shown in FIG. 3 can have advantages over a configuration in which a cable extends parallel to the terminal rows. Geometrical considerations present in a number of installations would favor the perpendicular cable in comparison with a parallel cable.

FIG. 1 shows a conventional semi-automatic insertion machine an apparatus 40 and a wire positioning adapter 42. This conventional semi-automatic wire inserter apparatus is more fully described in U.S. Pat. No. 3,766,622. A cantilever arm 66 extends from the front of machine 40. Wire adapter 42 is located on this cantilever arm. A clamp 58 having an L-shaped arm 90 extends from the top of machine 40. Cable 36 is attached to this clamp so that the cable extends perpendicular to cantilever arm 66 as well as to the terminals in a properly positioned connector. Notice that the ends of wires 2 which comprise cable 36 have been bent so that they extend upwardly and away from cantilever arm 66. Wire positioning adapter 42 has a wire positioning surface located on its left end when viewed in FIG. 1. Two wires have been grasped by the operator and laced across the leading edge 46 of this planar wire positioning surface. The operator is shown with these wires in his hands and with his thumbs positioned against lower wire guides 48. The use of adapter 42 will be more fully described below.

FIG 4 is an enlarged perspective view showing the wire positioning adapter 42 and cantilever arm 66 which extends from machine 40. Adapter 42 has a hollow shell-like housing 52 which is dimensioned to receive the outer portion of cantilever arm 66 within the internal cavity 64. The end of housing 52 facing arm 66 in FIG. 4 will be referred to as the front of the adapter 42. A planar wire positioning surface 44 extends from the top of adapter 42. This surface has a transversely extending leading edge 46. Projections 62 are located at either end of leading edge 46. Two legs 47 extend from opposite sides of housing 52. These legs extend generally from the lower side of housing 52. Wire guides 48 are located on the ends of legs 47. These guides comprise enlarged members which are generally in alignment with leading edge 46. Grooves 60 are located in each wire guide 48. Auxiliary tabs 50 are located on the outside of housing 52. These tabs are in the neighborhood of wire guides 48 but are located nearer the center of housing 52. Cantilever arm 66 and block 68 can be placed in central cavity 64. The lower surface of arm 66 can then slide along the upper ledges 72 which comprise extensions of legs 47.

Figure 5:
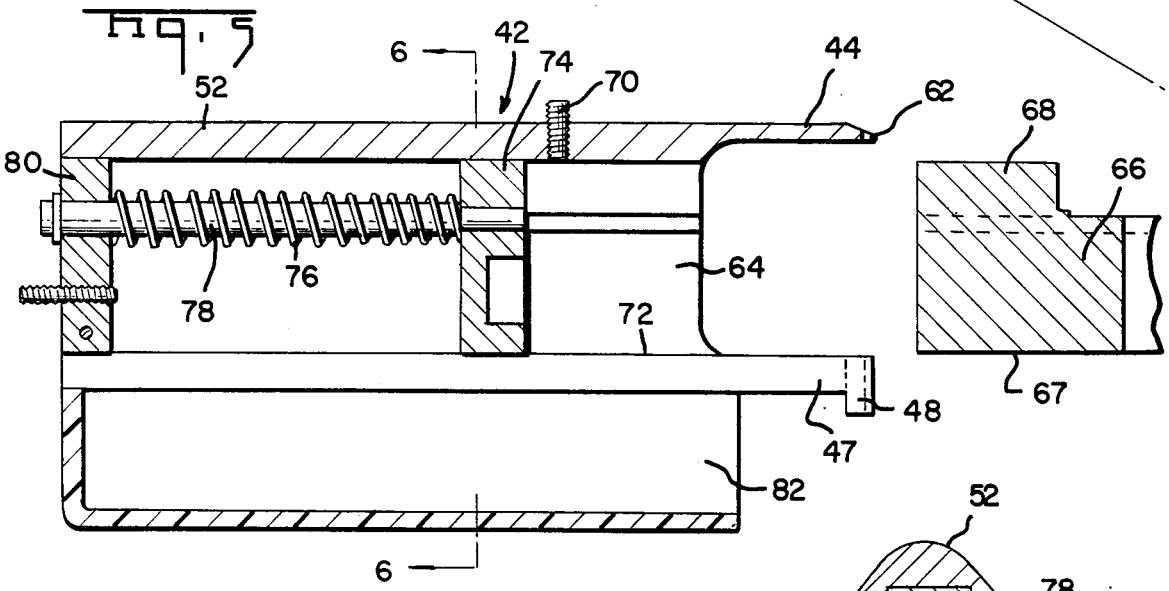
FIG. 5 is a side sectional view of the adapter.

FIG. 5 is a sectional view of the wire positioning adapter showing the adapter in alignment with the arm 66. An internal block 74 is located in cavity 64. A rod 78 extends from block 78 to base plate 80 located on the left of housing 52. A helical spring 76 is positioned around rod 76. When block 74 is in the position shown in FIG. 5, this spring is relaxed.

Figure 6:
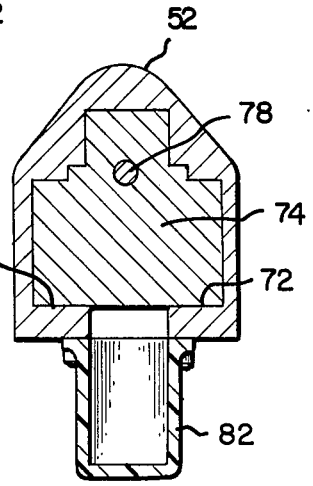
FIG. 6 is an end view of the adapter.

FIG. 6 is an end view of the wire positioning adapter. This view extends into cavity 64 and shows block 74 and ledges 72. Lower housing 82 which encloses certain portions of arm 66 is also shown in this Figure.

Figure 11:
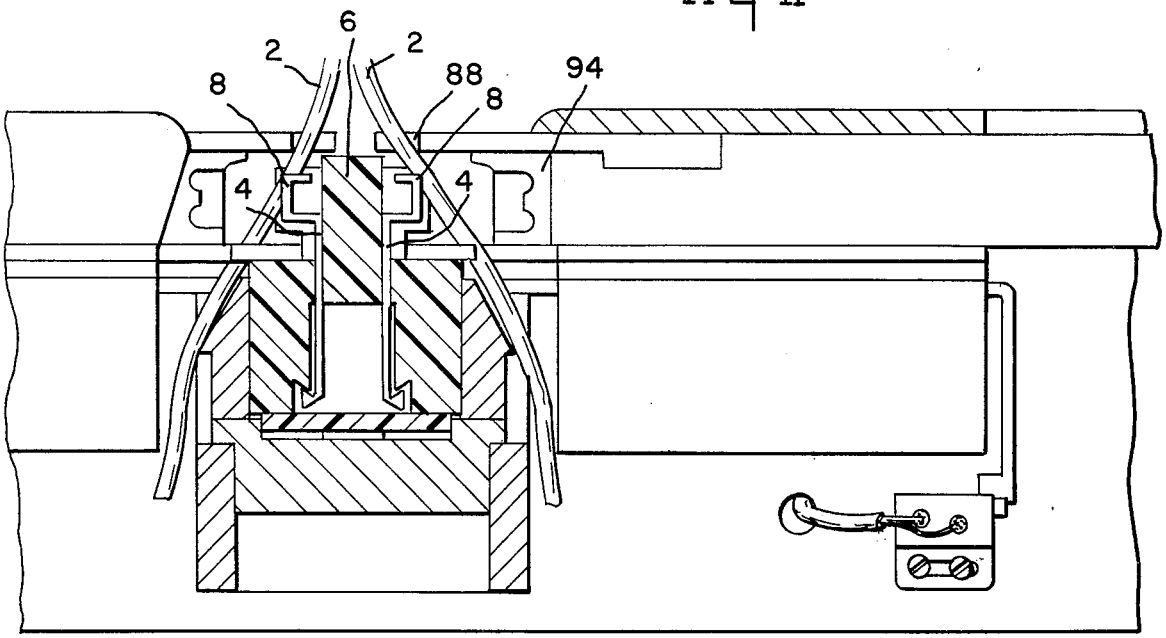
FIG. 11 shows the insertion punch mechanism used to laterally move the wires into the wire-receiving portions of two oppositely facing terminals.
Figure 12:
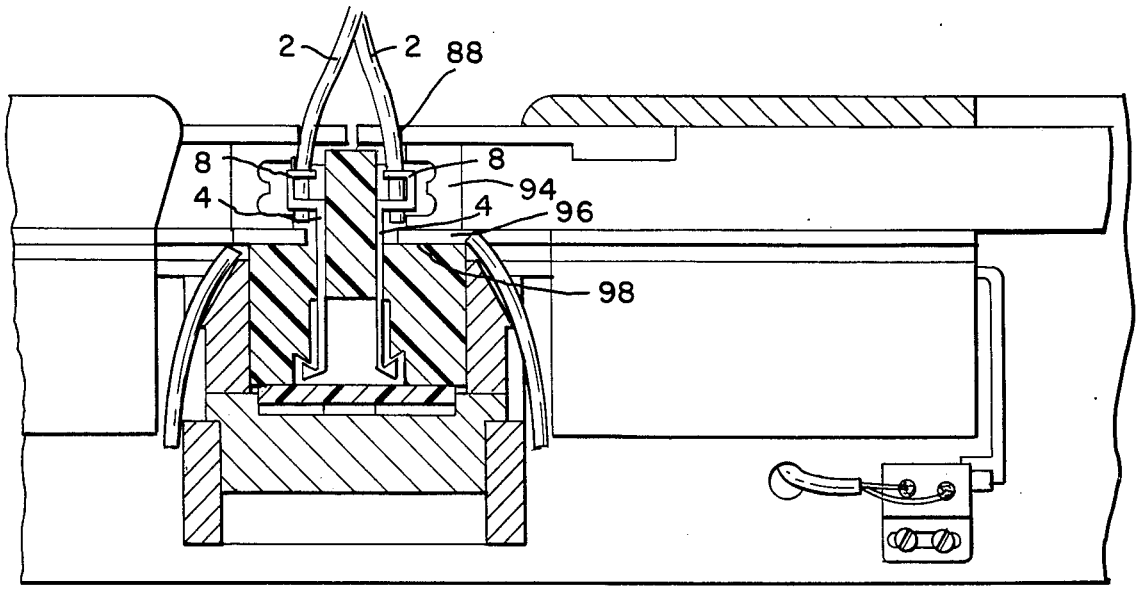
FIG. 12 illustrates the completion of the wire insertion operation.

FIG. 11 shows the insertion punch used to insert two wires into oppositely facing contact terminals. The standard semi-automatic insertion machine incorporates two punches, one on each side of the connector. These punches move in the insertion punch housing 100 shown in FIG. 1. The punches move perpendicular to the terminal rows in connector 6. Two insulated conductors 2 are first positioned across conductor stops 88 with one positioned on either side of connector 6. Each conductor is aligned with a wire receiving portion 8 of terminals 4. Wires 2 will then lie between terminals 4 and insertion punches 94. Insertion punches 94 are now activated and each punch moves towards the connector. Conductors 2 are then moved laterally of their respective axes into wire receiving portions 4. In the particular connector illustrated in these Figures, wire receiving portion 8 comprise slotted plate members which penetrate the insulation of wires 2 and establish electrical contact with the underlying conductive core. FIG. 12 also shows the shearing of wires 2. A movable shear blade 96 moves inwardly with insertion punches 94. Movable shear blades 96 engage fixed shear 98 to sever wires 2 as shown. This severing operation is not an essential part of this invention. Removable shear blade 98 and insertion of wires without trimming might be desirable in some applications. The entire insertion operation shown in FIGS. 11 and 12 is covered in more detail in U.S. Pat. No. 3,766,622.

Figure 7:
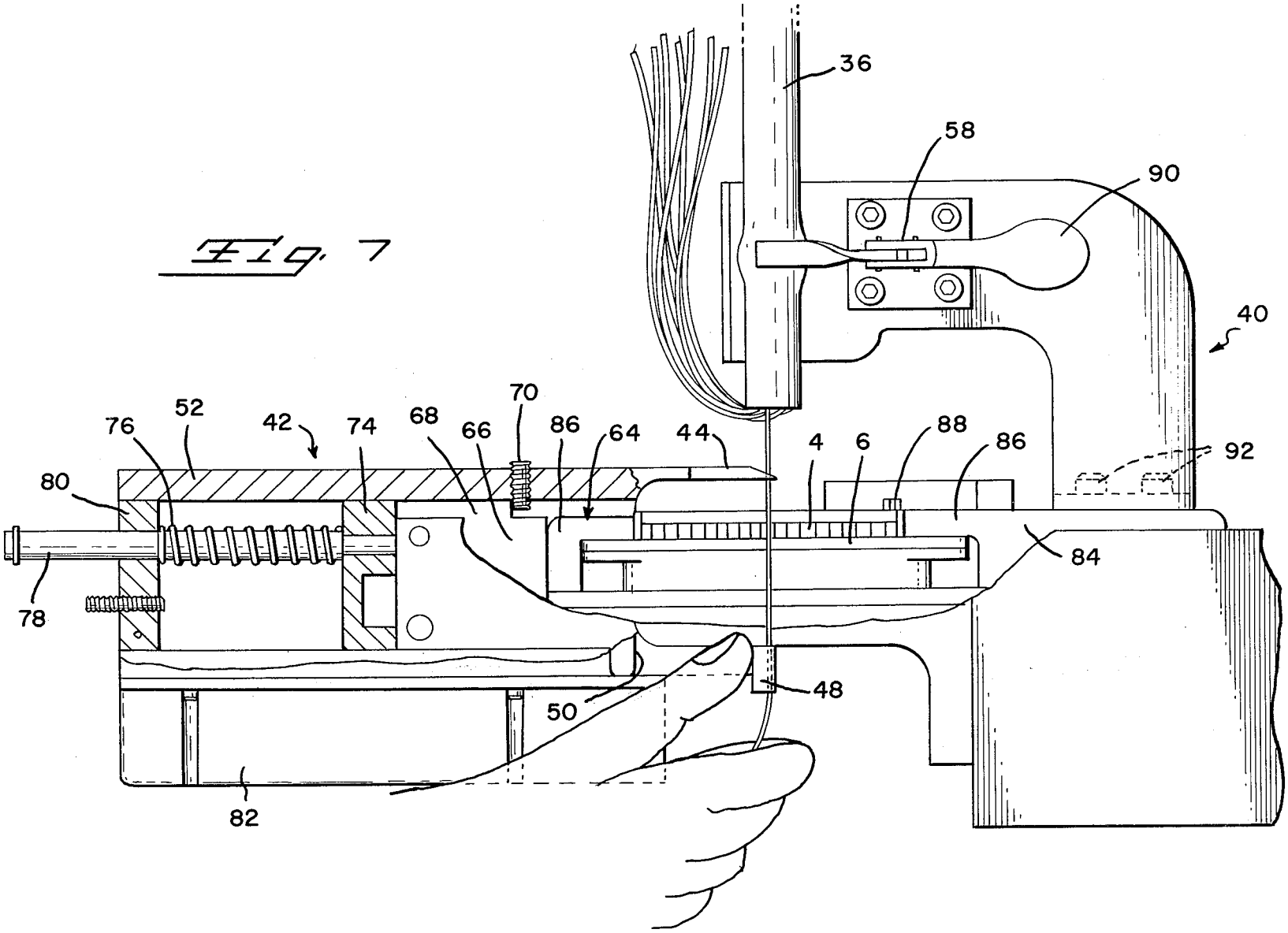
FIG. 7 shows the first step in dressing a wire.
Figure 8:
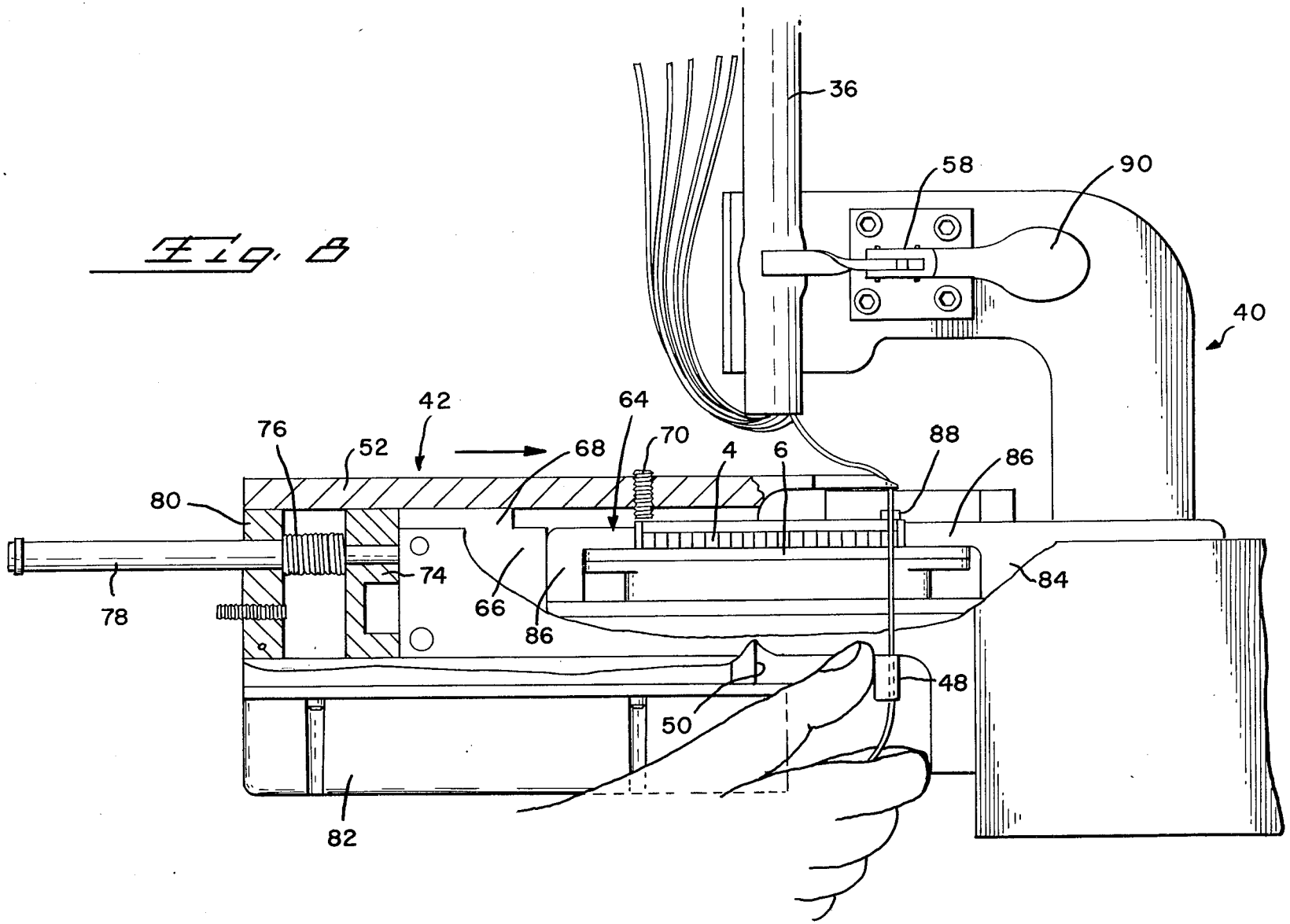
FIG. 8 shows the positioning of a wire in a terminal at the far end of the connector.

FIGS. 7–10 show the operation of wire positioning adapter 42 when used in conjunction with a standard semi-automatic insertion machine 40. Adapter 42 is mounted on the cantilever arm 66 as shown in FIG. 7. The left portion of cantilever arm 66 extends into cavity 64 of adapter 42. A screw 70 is located in the top of adapter housing 52. This screw 70 extends into cavity 64 and engages block 68 which forms the left end of arm 66. Screw 70 thus prevents adapter 42 from moving to the left beyond the position shown in FIG. 7.

Block 74 abutts the extreme left end of cantilever arm 66 and causes flexure of spring 76 as shown in this Figure. The adapter is free to move to the right against the action of spring 76, but movement to the left is prevented.

Connector 6 is mounted on carriage support 84. Yokes 62 on either end of the carriage firmly secure the connector to carriage 84. Cable clamp 58 is attached to L-shaped clamp arm 90. Clamp arm 90 is firmly secured to carriage support 84 by means of bolts 92. Carriage 84 is itself movable with respect to fixed cantilever arm 66. Carriage 84 is movable parallel to the rows of terminals 4 in connector 6. Conductor stop 88 extends above connector 6 as shown in FIGS. 7 and 11. Stop 88 is aligned with the terminal on the extreme right in FIG. 7. Conductor stop 88 is not fixed to carriage 84 and carriage 84 plus connector 6 is free to move past the location of conductor stop 88. Conductor stop 88 defines the location of the insertion station. Insertion punches 94, in alignment with the terminal located below conductor stop 88 act to insert a pair of conductors at this station.

Cable 36 is attached to cable clamp 58 and extends perpendicular to rows of terminals 4. The clamped position of cable 36 is located intermediate the ends of the terminal rows. In FIG. 7, cable 36 is clamped at the mid point of the terminal rows. Note that individual wires 2 have been bent upward so that they remain clear of the adapter and connector.

Figure 9:
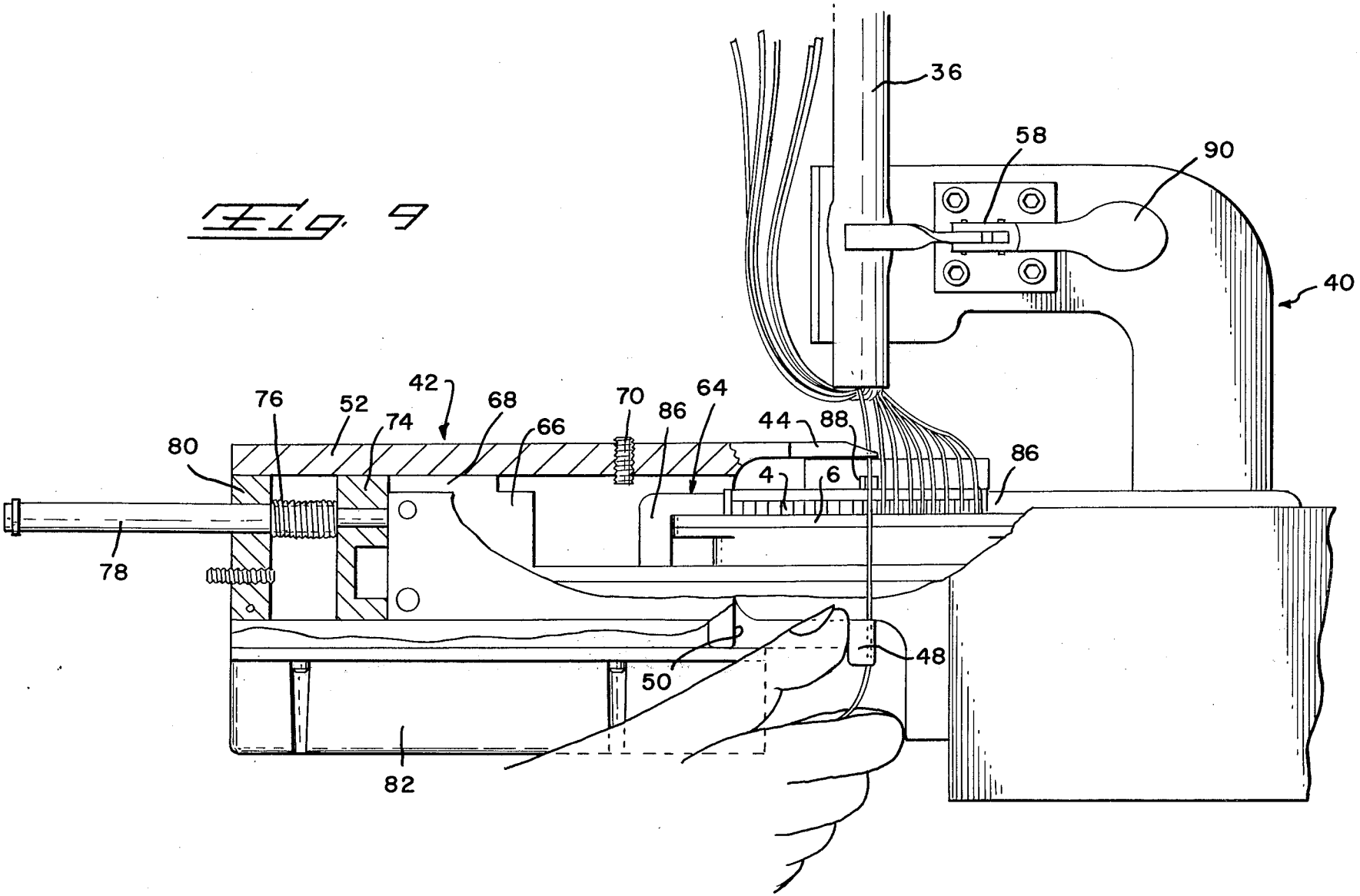
FIG. 9 shows the positioning of a wire near the center of a terminal row.
Figure 10:
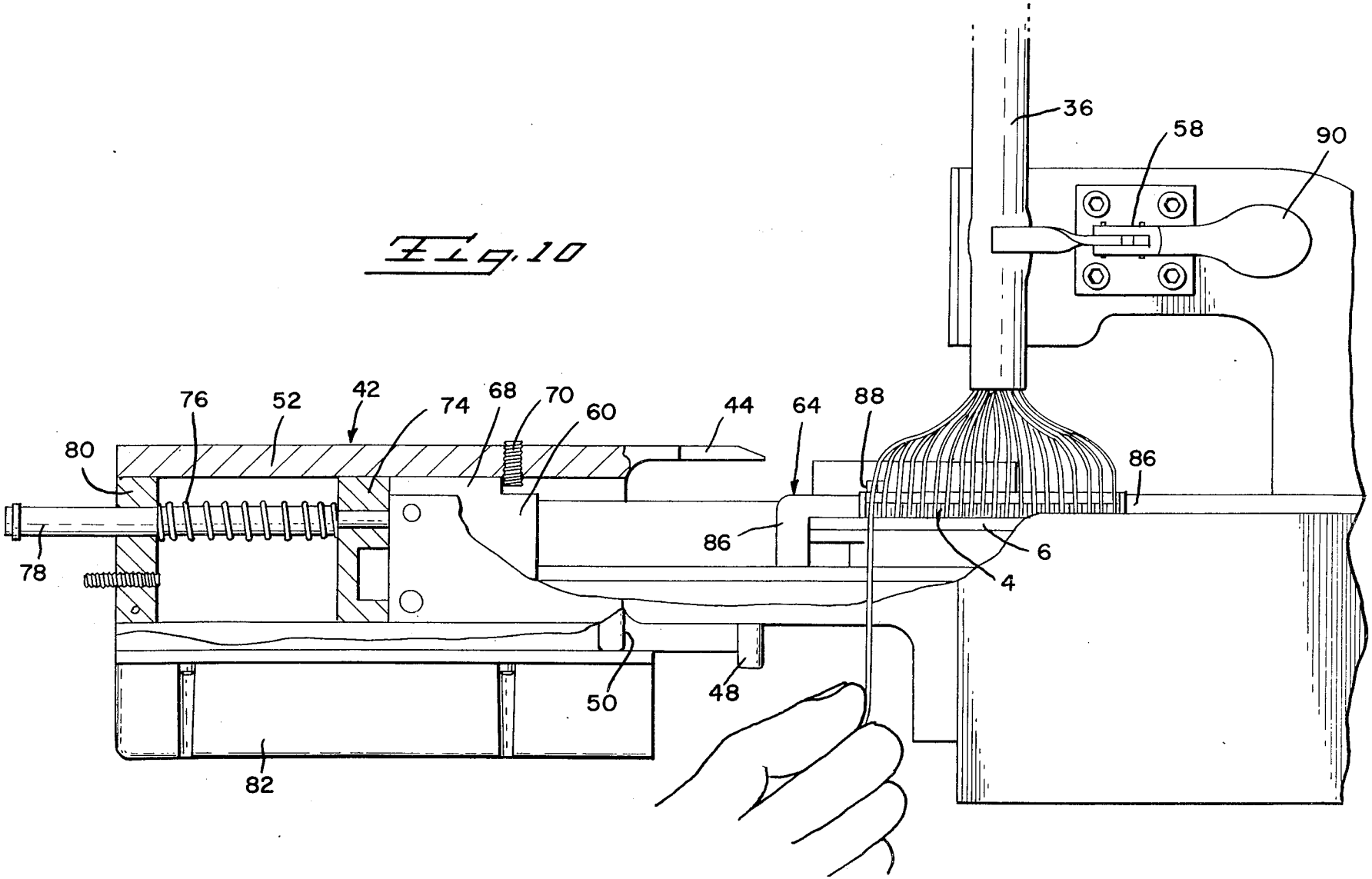
FIG. 10 shows the positioning of a wire at the near end of the connector.

FIG. 7 shows the first step in the insertion operation. An operator selects two wires and brings two wires down from cable 36. One wire would be on each side of connector 6. The wire selected in FIG. 7 has been laced across the leading edge 46 of upper wire positioning surface 44. Note that leading edge 46 is transverse to the path of the movable carriage and is parallel to the path of the insertion punches. This wire is then positioned in wire groove 60 of lower wire guide 48. The operator grips one wire in the fingers of each hand below wire guide 48. At this point, the operator exerts pressure against wire guide 48 and, using his thumbs, pushes the adapter to the right. The adapter is moved to the right and into the position shown in FIG. 8. During movement of adapter 42 from the position of FIG. 7 to the position of FIG. 8, the operator allows the wire to slip longitudinally between his fingers and across leading edge 46 of wire positioning surface 44. The wire selected has now been dressed from the central location of the multi-conductor cable to a terminal location adjacent the right hand end of the connector shown in FIG. 8. This is the remote end from the operator's viewpoint. This wire now abutts conductor stop 88 and insertion punches can now be activated to insert this wire into the aligned terminal. The operator now releases the adapter 42 and spring 76 returns the adapter to the position of FIG. 7. After the first wire has been inserted, the semi-automatic insertion apparatus indexes the carriage support 84 to the right so that the next terminal is positioned in alignment with conductor stop 88. When an individual wire abutts conductor stop 88 and appropriate switches, more fully disclosed in U.S. Pat. No. 3,766,622 are activated the insertion and subsequent indexing steps are performed. Note that since cable clamp 58 is attached to carriage 84, the cable clamp and the attached cable 36 also move to the right upon indexing. The same operation illustrated by FIGS. 7 and 8 can now be carried out for the next wire and terminal. FIG. 9 shows the insertion of a subsequent wire into a terminal nearer the center of a terminal row. Note that this terminal is still on the right or more remote side of the connector. The same operation has been performed in FIG. 9 as previously discussed. Note the relative position of the end of cable 36 and conductor stop 88 in FIGS. 7 and 9. It is clear that the cable is moved in relationship to the insertion station. After the cable passes conductor stop 88, adapter 42 is no longer necessary. Each wire 2 can now be laced directly across conductor stop 88 by the operator. Therefore, wires attached to terminals adjacent the left end of connector 6 do not require use of adapter 42. FIG. 10, shows the orientation of wires 2 and the completed cable-connector assembly. Notice that the wires are symmetrical about the center of a terminal row. When using a standard semi-automatic insertion machine, the cable would extend parallel to the terminal rows and from the right when viewed in FIGS. 7–10. Wires attached at the right end of the connector, nearest the cable, would then be shorter than wires attached to the left end of the connector. The cable could not then extend perpendicular to the connector and terminal rows as shown in FIGS. 3 and 10.

Several alternative embodiments which clearly are included within this invention can be envisioned. For example, the planar wire positioning surface 44 could be replaced by a transverse cylindrical rod. This rod might even rotate to minimize friction as the wires slip across its leading edge. This and other embodiments would clearly be within the scope of this disclosure and the following claims.

What is claimed is:

1. A method of attaching the wires in a multi-conductor cable to terminals in two parallel rows in a multi-contact connector by inserting the wires into wire-receiving portion of said terminals so that said cable ultimately extends perpendicular to said rows, said method comprising the steps of:

positioning said connector generally between an operator and an insertion station with one pair of terminals in said insertion station, clamping said cable in a fixed position relative to said connector with the end of said cable intermediate the ends of said rows, adjacent said wire receiving portions, and spaced from said insertion station, said operator grasping a wire in each hand and placing said wires on opposite sides of said connector proximate to said cable end, positioning said wires against an elongated surface extending transverse of the longitudinal axis of said wires at a point between the point where said cable is clamped and said connector, moving said elongated surface relative to said connector along a linear path parallel to said rows away from said operator and toward said insertion station, allowing said wire to longitudinally slip through said operator's hands and across said elongated surfaces during movement of said elongated surface, and moving insertion punches located on opposite sides of said connector towards each other and into said insertion station along a path parallel to said elongated surface to insert said wires into the wire receiving portions of terminals located in said insertion station.

2. A method as set forth in claim 1 wherein all of said steps are repeated upon alignment of a subsequent pair of terminals in said insertion station until said clamped portion of said cable is advanced to said insertion station.

3. A method as set forth in claim 2 whereby upon passage of said clamped end of said cable past said insertion station and the alignment of terminals between said clamped end and said operator in said insertion station, remaining wires are brought towards the operator and positioned in said insertion station for insertion into said wire receiving portion.

4. A method as set forth in claim 1 wherein said wires are laced across said elongated surface and across guide members aligned with said elongated surface and positioned below said connector and on opposite sides of said connector, said wires being held by said operator in the vicinity of said guide members.

5. A method as set forth in claim 4 wherein said operator holds said wires in his fingers and places his thumbs against said guide members to push said elongated surface and said guide members toward said insertion station.

6. In an apparatus for inserting a plurality of individual wires contained in a multi-conductor cable into wire receiving portions of terminals aligned in two parallel rows on a multi-contact connector, wherein said apparatus comprises supporting carriage means for positioning said connector and sequentially moving said connector along an axis parallel to said rows; insertion punch means movable towards and away from said connector along an axis generally perpendicular to said rows to insert said wires into said wire receiving portions; a conductor stop for positioning individual wires between said connector and said insertion punch means and in alignment with one of said terminals; the improvement comprising:

clamping means for positioning said cable at a fixed position between the ends of said rows with said cable extending generally perpendicular to said rows, and a wire positioning adapter comprising wire positioning surface means movable relative to said supporting carriage means and relative to said connector along a linear path parallel to said rows from a retracted position to an extended position, said fixed position of said cable being between said retracted and extended positions, said extended position being proximate to said conductor stop, whereby a wire can be attached to a terminal between said clamping means and one end of said row by lacing a wire across said wire positioning surface and moving said wire positioning surface along said linear path until said wire abuts said conductor stop, said wire then being inserted into one of said wire receiving portions so that said cable can be attached intermediate the ends of said rows.

7. An apparatus as set forth in claim 6 wherein said wire positioning surface means is spaced from the position of said connector on said supporting carriage means by a distance greater than said conductor stop and less than said clamping means.

8. An apparatus as set forth in claim 7 wherein said wire positioning surface means comprises an elongated surface extending generally perpendicular to said rows.

9. An apparatus as set forth in claim 8 wherein said elongated surface comprises the edge of a plate like member.

10. An apparatus as set forth in claim 9 wherein said plate-like member has projections extending from each end of said edge, said projections preventing said wire from slipping off of said edge.

11. An apparatus as set forth in claim 7 wherein said wire positioning adapter has wire guide means spaced from said wire positioning surface means, said wire guide means being located on the opposite side of said supporting carriage means from said wire positioning surface means so that said wire may be restrained above and below said connector for presentation of said wire to said conductor stop.

12. An apparatus as set forth in claim 11 wherein said wire guide means comprises a laterally extending surface generally aligned with said wire positioning surface means.

13. An apparatus as set forth in claim 2 wherein said laterally extending surface has a groove therein or receiving said wire in said groove.

14. An apparatus as set forth in claim 2 wherein said laterally extending gripping means are spaced from said wire guide means and said wire positioning surface means so that pressure may be exerted on said gripping means to move said wire positioning surface means and said wire guide means from said retracted to said extended position.

15. An apparatus as set forth in claim 14 wherein said supporting carriage means is mounted on a cantilever arm, said supporting carriage means positioning said connector with said rows generally parallel to said arm and said wire positioning adapter comprises a hollow shell like member, said adapter being mounted on said supporting carriage means with said arm within said hollow shell-like member.

16. An apparatus as set forth in claim 15 wherein a resilient spring extends between the end of said arm opposite said conductor stop and the end of said shell-like member opposite said wire positioning surface means.

17. An apparatus as set forth in claim 6 wherein said wire positioning adapter is spring loaded with respect to said supporting carriage means.

18. In an apparatus for attaching the wires in a multi-conductor cable to terminals aligned in two parallel rows on a multi-contact connector by simultaneously inserting two wires into oppositely facing wire receiving portions of two terminals, one terminal in each row, wherein said apparatus comprises a stationary cantilever arm with carriage means located on top of said arm for supporting said connector with said rows parallel to the axis of said arm, said carriage means movable along a path parallel to said axis; two insertion punches on opposite sides of said carriage means, said insertion punches being movable towards and away from each other along a path generally perpendicular to said axis to insert a wire between any one of said punches and said connector into one of said wire receiving portions; a conductor stop above said carriage means and adjacent to each of said insertion punches, said carriage means being movable past said conductor stops; the improvement therein comprising:

clamping means for locating one end of said cable above said connector and generally above said conductor stop with said cable end being intermediate the ends of said rows, said clamping means being fixed to said carriage means, a wire positioning adapter mounted on said cantilever arm and movable with respect to said arm and said carriage means along a linear path parallel to said axis of said cantilever arm, a generally plate-like wire positioning surface on said wire positioning adapter located above said cantilever arm and on the end of said adapter adjacent to said conductor stops, a leading edge on said wire positioning surface which is generally parallel to the path traversed by said insertion punches, said wire positioning surface being movable between said clamping means and said conductor stops, and lower wire guides on said adapter located on both sides of said cantilever arm and below said carriage means, said wire guides being generally aligned with said leading edge of said wire positioning surface, whereby a pair of wires from said cable can be laced across appropriate wire guides while said adapter is adjacent to said cable end and said adapter can then be moved along said linear path until said leading edge locates said wires against said conductor stops, said wires being free to slide in the direction of the axis of said wires across said leading edge during movement of said adapter to that said wires may be inserted into the wire receiving portions of appropriate terminals.

19. In an apparatus for inserting a plurality of individual wires contained in a multi-conductor cable into wire-receiving portions of terminals aligned in two parallel rows on a multi-contact connector, wherein said apparatus comprises insertion punch means movable towards and away from said connector along an axis generally perpendicular to said rows to insert said wires into said wire receiving portions; supporting carriage means for positioning said connector with said connector being movable relative to said insertion punch means along an axis parallel to said rows; a conductor stop for positioning individual wires between said connector and said insertion punch means and in alignment with one of said terminals; the improvement comprising:

clamping means for positioning said cable at a fixed position between the ends of said rows with said cable extending generally perpendicular to said rows, and a wire positioning adapter comprising wire positioning surface means movable relative to said supporting carriage means and relative to said connector along a linear path parallel to said rows from a retracted position to an extended position, said fixed position of said cable being between said retracted and extended positions, said extended position being proximate to said conductor stop, whereby a wire can be attached to a terminal between said clamping means and one end of said row by lacing a wire across said wire positioning surface and moving said wire positioning surface along said linear path until said wire abuts said conductor stop, said wire then being inserted into one of said wire receiving portions so that said cable can be attached intermediate the ends of said rows.

* * * * *